US005474968A

United States Patent [19]

Norimatsu

[11] Patent Number: 5,474,968

[45] Date of Patent: Dec. 12, 1995

[54] PRINTING TAPE AND PRINTING-TAPE CARTRIDGE

[75] Inventor: Takahiro Norimatsu, Nagoya, Japan

[73] Assignee: Brother Kogyo Kabushiki Kaisha, Nagoya, Japan

[21] Appl. No.: 305,438

[22] Filed: Sep. 13, 1994

[30] Foreign Application Priority Data

| | | | |
|---|---|---|---|
| Sep. 20, 1993 | [JP] | Japan | 5-233001 |
| Sep. 20, 1993 | [JP] | Japan | 5-233002 |
| Sep. 20, 1993 | [JP] | Japan | 5-233006 |

[51] Int. Cl.[6] ..... B41M 5/40

[52] U.S. Cl. ..... 503/226; 360/132; 503/200

[58] Field of Search ..... 427/152; 503/200, 503/226; 360/132

[56] References Cited

U.S. PATENT DOCUMENTS

| | | | |
|---|---|---|---|
| 2,712,507 | 7/1955 | Green | 503/216 |
| 2,730,457 | 1/1956 | Green et al. | 503/216 |
| 4,833,116 | 5/1989 | Yamori et al. | 503/200 |
| 4,925,324 | 5/1990 | Ichisawa | 400/240.3 |
| 4,927,278 | 5/1990 | Kuzuya et al. | 400/208 |
| 5,238,900 | 8/1993 | Shuku | 503/207 |

FOREIGN PATENT DOCUMENTS

| | | | |
|---|---|---|---|
| 272232 | 6/1988 | European Pat. Off. | 503/226 |
| 0512168 | 11/1992 | European Pat. Off. | 400/208 |
| 3536340 | 4/1986 | Germany | 428/213 |
| 1-104359 | 7/1989 | Japan | 503/226 |

*Primary Examiner*—B. Hamilton Hess
*Attorney, Agent, or Firm*—Oliff & Berridge

[57] ABSTRACT

Disclosed is a printing tape T having a support sheet 4, a heat-sensitive layer 3 including thermal chromogenic material formed on one surface of the support sheet 4, a protection layer 2 formed on the heat-sensitive layer 3, a colored transparent layer which is mainly formed of silicone resin curable at ordinary temperature including colorant such as dye or pigment. On the other surface of the support sheet 4, a removable sheet 6 is adhered through an adhesive layer 5. And a printing-tape cartridge C that a tape spool 10 around which the printing tape T mentioned above is wound is rotatably supported in a housing 11, is disclosed. When images such as characters are recorded on the printing tape T, the printing-tape cartridge C is set in a printer 20 having a thermal head 15 and the images are recorded on the printing tape T by the thermal head 15 while being derived from the tape spool 10.

18 Claims, 3 Drawing Sheets

PRINTING TAPE AND PRINTING-TAPE CARTRIDGE

BACKGROUND OF THE INVENTION

1. Field of the Invention

The present invention relates to a printing tape through which images such as characters are printed thereon by being heated through a thermal head, and in particular, relates to a printing tape, on a top surface of which a colored transparent layer defining background color of the printing tape is formed so that images such as characters can be clearly recognized in the background color and which can be adhered onto an object after printing of images is conducted. And the present invention relates to a printing-tape cassette or cartridge accommodating the above printing tape, which is utilized in a tape printer.

2. Description of Related Art

Conventionally, there have been proposed various printing tapes. These kinds of printing tapes are generally produced by forming a heat-sensitive or thermal chromogenic layer on a film-like support sheet. Here, for instance, in order to form the heat-sensitive or thermal chromogenic layer, a mixture of leuco-dye such as crystal violet lactone (CVL), which is disclosed in the specifications of U.S. Pat. Nos. 2,712,507 and 2,730,457, and organic acid such as phenol compound, is used.

On the surface of the heat-sensitive or thermal chromogenic layer, a protection layer for protecting the heat-sensitive or thermal chromogenic layer is formed and the protection layer is made transparent so that colored portions (i.e. images such as characters) can be visually recognized through the protection layer.

Further, on the surface of the support sheet opposite to the surface where the heat-sensitive or thermal chromogenic layer is formed, a colored layer is formed by coating print ink, which includes pigments or dyes, so that the images formed in the heat-sensitive or thermal chromogenic layer can be recognized in the background color defined by the colored layer. At that time, the background color of the colored layer is visually recognized through the support sheet, the heat-sensitive or thermal chromogenic layer and the protection layer.

In the thus produced printing tape, the heat-sensitive or thermal chromogenic layer is colored by being heated through a thermal head, thereby the image such as characters are formed in the background color defined by the colored layer, on the printing tape. And, in general, the printing tape is utilized in a tape printer in a state that the printing tape is accommodated in a printing-tape cartridge. In the case that printing of the images is conducted on the printing tape through the thermal head arranged in the tape printer, the heat-sensitive or thermal chromogenic layer is heated by the thermal head while both the thermal head and the printing tape are relatively moved. Thereby, the images such as characters are printed on the printing tape.

However, the heat-sensitive or thermal chromogenic layer formed from the mixture mentioned above is generally translucent and it is very difficult to make the heat-sensitive or thermal chromogenic layer transparent. Therefore, the background color of the colored layer recognized through the translucent chromogenic layer becomes blurred and whitened color, due to translucency of the heat-sensitive or thermal chromogenic layer such as frosted glass. As a result, inherent color of pigments or dyes in the colored layer cannot be seen. Clearly from the above, unless the support sheet, the heat-sensitive or thermal chromogenic layer and the protection layer are transparent, the background color of the colored layer formed cannot be recognized therethrough, so long as the colored layer is formed on the surface of the support sheet opposite to the surface where the heat-sensitive or thermal chromogenic layer is formed.

SUMMARY OF THE INVENTION

It is therefore an object of the present invention to provide a printing tape through which images such as characters can be clearly formed thereon in background color defined by a colored transparent layer formed on a heat-sensitive or thermal chromogenic layer on a support sheet and which can be adhered onto an object after printing of the images is conducted. And it is another object of the present invention to provide a printing-tape cartridge which accommodates such a printing tape as indicated above.

In order to accomplish the above-indicated objects, according to a first aspect of the present invention, it is provided a printing tape having a support sheet, a heat-sensitive layer formed on one surface of the support sheet and a protection layer formed on the heat-sensitive layer, the printing tape being used for a tape-recording printer including a thermal head which thermally records images on the printing tape, the printing tape comprising:

a colored transparent layer which is mainly formed of resin curable at ordinary temperature including colorant, the colored transparent layer being formed on the protection layer.

In the printing tape of the present invention, the colored transparent layer is formed on the outermost surface of the printing tape and the colorant in the colored transparent layer determines a background color of the printing tape. Therefore, the images recorded on the printing tape can be clearly recognized in the background color determined through the colored transparent layer, in case that both the support sheet and the heat-sensitive layer are not transparent. As a result, based on that it is not necessary that the support sheet and the heat-sensitive layer are transparent, materials for forming the support sheet and the heat-sensitive layer can be freely selected, thus the materials utilizable for the support sheet and the heat-sensitive layer are increased.

And according to a second aspect of the present invention, it is provided a printing-tape cartridge accommodating a printing tape, for use with a tape-recording printer including a thermal head which thermally records images on the printing tape, the printing-tape cartridge comprising:

a housing;

a tape spool disposed inside the housing so that the tape spool is rotatable, the printing tape being wound around the tape spool;

wherein the printing tape comprises a support sheet, a heat-sensitive layer formed on one surface of the support sheet, a protection layer formed on the heat-sensitive layer and a colored transparent layer formed on the protection layer, the colored transparent layer being mainly formed of resin curable at ordinary temperature including colorant.

In the printing-tape cartridge of the present invention, when the images are recorded on the printing tape by the thermal head arranged in the tape-recording printer, the printing tape is derived from the tape spool rotatably disposed in the housing of the printing-tape cartridge and the images are thermally recorded on the printing tape by the thermal head. At that time, similarly to the above, the colored transparent layer is formed on the outermost surface of the printing tape and the colorant in the colored transparent layer determines a background color of the printing tape. Therefore, the images recorded on the printing tape can be clearly recognized in the background color determined through the colored transparent layer, in case that both the support sheet and the heat-sensitive layer are not transparent. As a result, based on that it is not necessary that the support sheet and the heat-sensitive layer are transparent, materials for forming the support sheet and the heat-sensitive layer can be freely selected, thus the materials utilizable for the support sheet and the heat-sensitive layer are increased.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The present invention will be described with reference to the following drawings, wherein.

DETAILED DESCRIPTION OF THE PREFERRED EMBODIMENTS

A detailed description of the preferred embodiment of a printing tape embodying the present invention will be given referring to the accompanying drawings.

Figure 1:
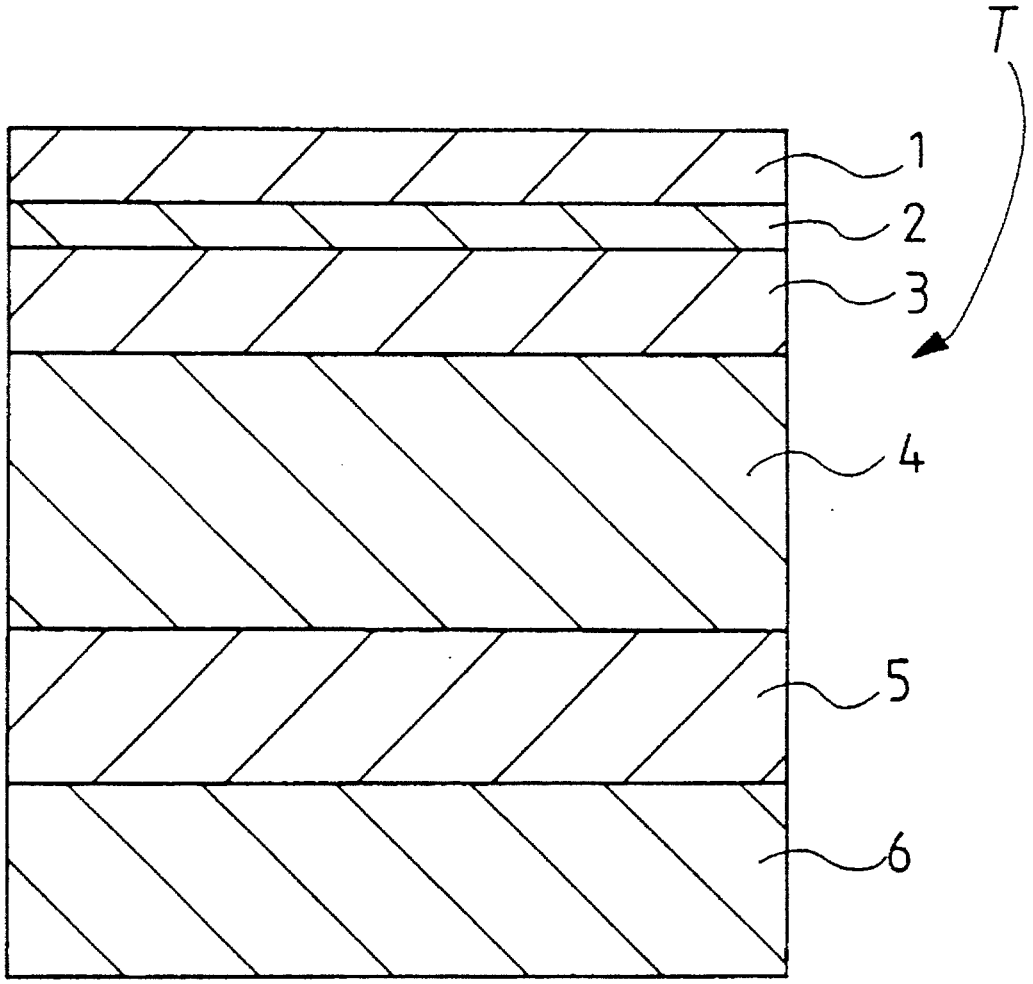
FIG. 1 is a schematic sectional view of a printing tape in accordance with the present invention.

Referring to FIG. 1, there is shown a printing tape according to the present invention. In the printing tape T, a removable sheet 6 is adhered onto one surface of a support sheet 4 (lower surface of the support sheet 4 in FIG. 1), through an adhesive layer 5. And onto the other surface of the support sheet 4 (upper surface of the support sheet 4 in FIG. 1), a heat-sensitive or thermal chromogenic layer 3 is formed. Further, on the heat-sensitive or thermal chromogenic layer 3, a protection layer 2 is formed. And on the protection layer 2, a colored transparent layer 1 is formed, the colored transparent layer 1 being mainly composed of resin in which pigments are dispersed or dyes are dissolved, the resin being curable or hardenable at ordinary (room) temperature.

Here, the heat-sensitive or thermal chromogenic layer 3 is formed of a composition containing a leuco-dye; a color developer, which reacts, when being heated, with the leuco-dye to develop a color from the dye; a reaction promoter which promotes the reaction of the leuco-dye and the developer; and a binder which binds the leuco-dye and the developer. The thermally chromogenic composition may further contain a pigment and/or an auxiliary agent (described hereinafter).

The leuco-dye suitable for the thermal chromogenic layer 3 is preferably selected from the leuco-dyes which are colorless or hypochromic, as follows.

(a) triphenylmethane dyes such as;
3,3-bis(p-dimethylaminophenyl)phthalide,
3,3-bis(p-dimethylaminophenyl)-6-dimethylaminophthalide, (also referred to as Crystal Violet lactone)
3,3-bis(p-dimethylaminophenyl)-6-chlorophthalide, and
3,3-bis(p- dibutylaminophenyl)phthalide, (also referred to as Malachite Green lactone), (b) fluoran dyes such as
3-dimethylamino-6-methoxyfluoran,
3-dimethylamino-6-methyl-7-chlorofluoran,
3-dimethylamino-5-methyl-7-dibenzylaminofluoran,
3-diethylamino-7-chlorofluoran,
3-diethylamino-7-methoxyfluoran,
3-diethylamino-7-methylaminofluoran,
3-diethylamino-7-dibenzylaminofluoran,
3-diethylamino-7-(N-methylanilino)fluoran,
3-diethylamino-7-othochloroanilinofluoran,
3-diethylamino-7-(3-fluoromethyl)phenylaminofluoran,
3-diethylamino-7,8-benzofluoran,
3-diethylamino-6-methyl-7-chlorofluoran,
3-diethylamino-6-methyl-7-anilinofluoran,
3-diethylamino-6-methyl-7-p-butylanilinofluoran,
3-diethylamino-5-methyl-7-dibenzylaminofluoran,
3-morpholino-5,6-benzofluoran,
3-ethyl-6-diethylaminofluoran,
2-anilino-6-diethylaminofluoran,
3-(N-methyl-N-cyclohexylamino)-6-methyl-7-anilinofluoran, and
3-(N-p-tolyl-N-ethylamino)-6-methyl-7-(N-phenylamino)fluoran, (c) phenothiazine dyes such as
benzoyl Leucomethylene Blue,
2,2-dimethyl Leucomethylene Blue,
p-anisoyl Leucomethylene Blue, and
N-pivalyl Leucomethylene Blue, (d) Rhodamine lactam dyes such as
N-phenyl Rhodamine β lactam, and
acid Rhodamine β sulton, and (e) spiropyran dyes such as
benzo-β-naphthospiropyran, and
1,3,3-trimethyl-6'-chloro-8'-methoxy-indolinobenzospiropyran. In addition to the above, it is utilizable
2-[3,6-bis(diethylamino)-9-(o-chloroanilino) xanthyl and benzoic lactam.

The color developer suitable for the thermal chromogenic layer 3 is preferably selected from phenolic compounds which liquefy or gasify at temperatures higher than room temperature so as to react with the above-described leuco-dye and thereby develop a color from the dye. The phenolic compounds preferably used in the present invention are as follows:
4,4'-isopropylidenediphenol,
4,4'-isopropylidenebis(2-chlorophenol),
4,4'-isopropylidenebis(2-methylphenol),
4,4'-isopropylidenebis(2-tert-butylphenol),
4,4'-sec-butylidenediphenol,
4,4'-cyclohexylidenediphenol,
4-tert-butylphenol,
4-tert-octylphenol,
4-tert-octylcatechol,
4-phenylphenol (i.e., p-phenylphenol)
4-hydroxy diphenoxide,
2,2-bis(p-hydroxyphenyl)propane (i.e., bisphenol A),
2,2-bis(p-hydroxyphenyl)buthane,
2,2-bis(2,5-dibrom-4-hydroxyphenyl)propane,
2,2'-dihydroxydiphenol,
2,2'-methylenebis(4-chlorophenol),
α-naphtol,
β-naphtol, methyl-4-hydroxybenzoate,
benzyl-4-hydroxybenzoate,
ethyl-4-hydroxybenzoate,
propyl-4-hydroxybenzoate,
4-hydroxy-acetophenone,
novolak phenolic resins,
halogenated novolak phenolic resins,
other phenilic resins,
benzoic acid,
salicylic acid,
tartaric acid,
gellic acid.

The reaction promoter suitable for for the thermal chromogenic layer 3 is preferably selected from stearic acid amide, methylenebis (stearic acid amide), oleic acid amide, palmitic acid amide, sperm-whale oleic acid amide, coconut fatty acid amide, etc.

The binder suitable for the thermal chromogenic layer 3 is preferably selected from water-soluble polymer such as polyvinyl alcohol, starch, denatured starch, derivatives of starch, methyl cellulose, hydroxyethyl cellulose, carboxymethyl cellulose, gum arabic, gelatin, casein, polyvinyl pyrrolidone, polyacrylamide, salt of polyacrylic acid, styrene/butadien copolymer, polyvinyl acetate, ester of polyacrylic acid, or water emulsion of polymer such as polystyrene, polyvinyl chloride/polyvinyl acetate copolymer, polybutyl methacrylate.

The composition used for forming the thermal chromogenic layer 3 may further contain a white pigment such as talc, clay, silica, titanium oxide, or ureaformaldehyde resin; and/or an auxiliary agent such as various waxes, metallic salt of higher fatty acid, higher fatty acid amide, dispersant, lubricant, or anti-foamer. Here, the thermal chromogenic layer 3 is preferably coated and formed on the support sheet 4 with a thickness in a range of 2~20 g/m$^2$, especially 5~10 g/m$^2$, after being fully dried.

The protection layer 2 is provided over the thermal chromogenic layer 3 to protect the thermal chromogenic layer 3 so that the thermal chromogenic layer 3 is not invaded by the solvent included in the solution of silicone resin which is curable at ordinary (room) temperature (later mentioned). The protection layer 2 is preferably formed of various water-soluble resins which have film-forming ability. Such water-soluble resin is preferably selected from polyvinyl alcohol, methyl cellulose, ethyl cellulose, carboxymethyl cellulose, hydroxyethyl cellulose, polyacrylamide, starch, gelatin, polyvinyl pyrrolidone, or methoxy cellulose. And the protection layer is formed of mixture including such one or two water-soluble resins selected form the above.

For protecting the thermal chromogenic layer 3 against water or moisture, the protection layer 2 further contains an anti-water agent such as formalin, glyoxal, chrome alum, melamine, melamine formalin, polyamide resin, or polyamide epichlorhydrin resin. Here, the protection layer 2 is preferably coated and formed on the chromogenic layer 3 with a thickness in a range of 0.5~10 g/m$^2$, especially 1~5 g/m$^2$, after being fully dried.

The colored transparent layer 1 formed on the protection layer 2 is mainly formed of the silicone resin which is curable at ordinary temperature, the silicone resin being utilizable in solvent system, water system or ultraviolet curable resin system. Preferably for the colored transparent layer 1, it is utilizable the silicone resin or the urethane resin which are curable at ordinary temperature. For instance, as the silicone resin curable at ordinary temperature, resin silicone or rubber silicone curable at room temperature can be used. Concretely, various silicone coating agents (for instance, SR2410, SR2411, SE5060, SE5070, SE1980 from Toray Dow Corning Silicone Co.Ltd.) are available for the protection layer 2.

For the pigment dispersed in the resin curable at ordinary temperature, it is preferable the organic pigment or inorganic pigment used in ordinary print ink, the surface of the pigment being treated so that the pigment is easily dispersed in the resin.

And for the dye dispersed in the resin curable at ordinary temperature, it is preferably selected from xanthene dye, coumalin dye, merocyanine dye, thiazine dye, azine dye, methine dye, oxazine dye, phenylmethane dye, cyanin dye, azo dye, anthraquinone dye, pyrazoline dye, stilbene dye, or quinoline dye.

For the support sheet 4 of the printing tape T, it is preferably selected from plastic films such as polyethylene film, polyamide film, polyester film, polypropylene film, polyvinylchloride film or papers such as craft paper, Japanese paper. The adhesive used for forming the adhesive layer 5 is preferably selected from solvent-type acrylic adhesives, rubber adhesives, water-soluble adhesives, hot-melt adhesives, and emulsion-type adhesives. The removable sheet 6 is preferably produced by coating with silicone or polyethylene, opposite surfaces of a glassinc paper, craft paper or polyethylene terephthalate (PET).

[Production of Printing Tape T]

For producing printing tape T, first, a first disperse system is prepared in which a leuco-dye and a binder are dispersed, and a second disperse system is prepared in which a color developer and the same binder are dispersed. The first and second disperse systems are mixed with each other, and are agitated to provide a coating material for forming the thermal chromogenic layer 3. The coating material is applied, by using a coating device such as a bar, air knife, comma coater, reverse roll, or gravure roll, to one surface of the support sheet 4. Subsequently, the applied material is dried by being subjected to hot air, so that the chromogenic layer 3 is formed on the support sheet 4.

After the thermal chromogenic layer 3 is formed, a coating material for forming the protection layer 2 is applied onto the chromogenic layer 3 by the same coating device and the material is dried by being subjected to hot air, thereby the protection layer 2 is formed on the chromogenic layer 3. At that time, the protection layer 2 acts for protecting the thermal chromogenic layer 3 against the solvent in the resin solution including the resin curable at ordinary temperature, if it is conceivable that the solvent included in the resin solution for forming the colored transparent layer 1 affects the chromogenic layer 3. Thereafter, the resin solution, in which the pigment is dispersed or the dye is dissolved, for forming the colored transparent layer 1 is applied onto the protection layer 2. And after the resin solution is dried, the colored transparent layer 1 is formed. Further, the removable sheet 6, on one surface of which the adhesive layer 5 is coated, is adhered onto the opposite surface of the support sheet 4 through the adhesive layer 5. Thereby, the printing tape T is produced.

Next, an example of the concrete manner for producing the printing tape T will be detailedly described hereinafter.

[Example]

(a) Support Sheet 4

As the support sheet 4, a polyester film (CRISPER from Toyobo Co. Ltd.) with 38 μm thickness is prepared.

(b) Preparation Of Material For Thermal Chromogenic Layer 3

For preparing the coating material for forming the thermal chromogenic layer 3, first, a liquid A and a liquid B are prepared which have the following composition, respectively.

| | (parts by weight) |
|---|---|
| Liquid A | |
| 1. Leuco-dye crystal violet lactone | 15 |
| 2. Binder 20% aqueous solution of polyvinyl alcohol | 50 |
| 3. Water | 435 |
| Liquid B | |
| 1. Color developer bisphenol A | 60 |
| 2. Reaction promoter stearic acid amide | 10 |
| 3. Binder 20% aqueous solution of polyvinyl alcohol | 100 |
| 4. Calcium carbonate | 30 |
| 5. Water | 300 |

After the liquids A and B are prepared, each of the two liquids is homogenized using a ball mill, separately from each other, for twenty four hours. Subsequently, the liquids A, B are mixed with each other and sufficiently agitated to provide the coating material for forming the thermal chromogenic layer 3.

(c) Application Of The Coating Material

The thus obtained coating material is applied using a gravure roll to one of opposite major surfaces of the support sheet 4, to a thickness of 5 g/m$^2$ after being dried. The applied material is dried into the thermal chromogenic layer 3 on the support sheet 4.

(d) Production Of The Protection Layer 2

As a pre-treatment for forming the colored transparent layer 1 mainly composed of silicone resin on the thermal chromogenic layer 3, aqueous solution which includes 20% of polyvinyl alcohol (produced by Kuraray Co. Ltd., Japan), denatured NBR (nitryl.butadiene rubber produced by Takeda Chemical Industries Co. Ltd.) and acryl emulsion with self-crosslinking ability (produced by Rohm Co. Ltd.), is prepared. Thereafter, the thus solution is coated on the thermal chromogenie layer 3 through the gravure roll, to a thickness of 2 g/m$^2$ after being dried, thereby the protection layer 2 is formed on the chromogenic layer 3. The thus formed protection layer 2 is transparent without color.

(e) Production Of The Colored Transparent Layer 1

First, to form the colored transparent layer 1, urethane resin solution in which silicone resin is mixed is prepared according to the following composition.

| [Urethane resin solution] | (parts by weight) |
|---|---|
| 1. Polyurethane (UA-90 produced by Sanyo Chemical Industries Co. Ltd.) | 100 |
| 2. Polyurethane crosslinking agent (SCAT-24 produced by Sanyo Chemical Industries Co. Ltd.) | 1 |
| 3. Silicone resin | 30 |

-continued

| [Urethane resin solution] | (parts by weight) |
|---|---|
| curable at ordinary temperature (SR2411 produced by Toray Dow Corning Silicone Co. Ltd.) | |
| 4. Toluene | 100 |
| 5. Pigment (GVC-718 red produced by Dainichi Color & Chemicals Mfg. Co. Ltd.) | 5 |

The above compounds are mixed and agitated, thereby the urethane resin solution in which the pigment is dispersed is prepared. Thereafter, the urethane resin solution is coated through the gravure roll on the protection layer 2, to a thickness of 2 g/m$^2$ after being dried. Thereby, the colored transparent layer 1 is formed on the protection layer 2 by drying. Here, color of the transparent layer 1 becomes the color determined by the pigment.

(f) Preparation Of The Removable Sheet 6

First, an adhesive is prepared which has the following composition:

| [Adhesive] | (parts by weight) |
|---|---|
| 1. Oil and fat (Oil and fat AS-2050 from Ipposha Oil Industries Co. Ltd., Japan) | 100 |
| 2. Isocyanate-type hardener (B-45 from Ipposha Oil Industries Co. Ltd., Japan) | 2 |
| 3. Ethyl acetate | 30 |

The above compounds are mixed and agitated to provide an adhesive, which is then applied using a comma coater to one of opposite major surfaces of the removable sheet 6 formed of a 60 μm thick paper (70XT-032B from Fujimori Kogyo Co.Ltd., Japan) whose surfaces have been coated with silicone. Thus, the adhesive layer 5 is formed on the removable sheet 6, to a thickness of 20 g/m$^2$ after sufficiently being dried.

(g) Production Of Printing Tape T

The thus prepared removable sheet 6 is adhered on the surface of the support sheet 4, opposite to the surface where the thermal chromogenic layer 3, the protection layer 2 and the colored transparent layer 1 are formed. Thereby, the printing tape T is produced.

[Production Of Printed Tape]

Figure 2:
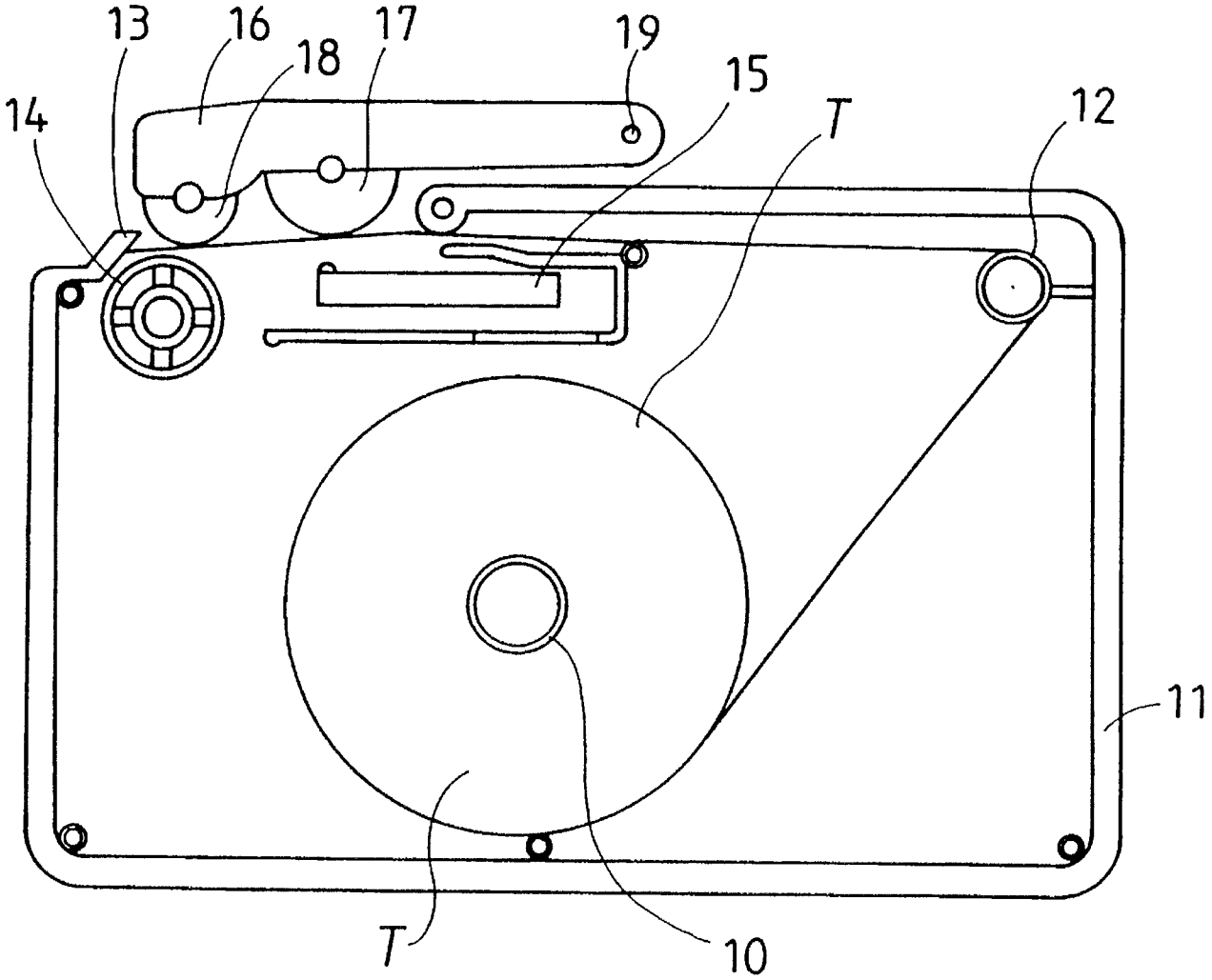
FIG. 2 is a plan view of a lower half housing of a tape cartridge in accordance with the present invention.
Figure 3:
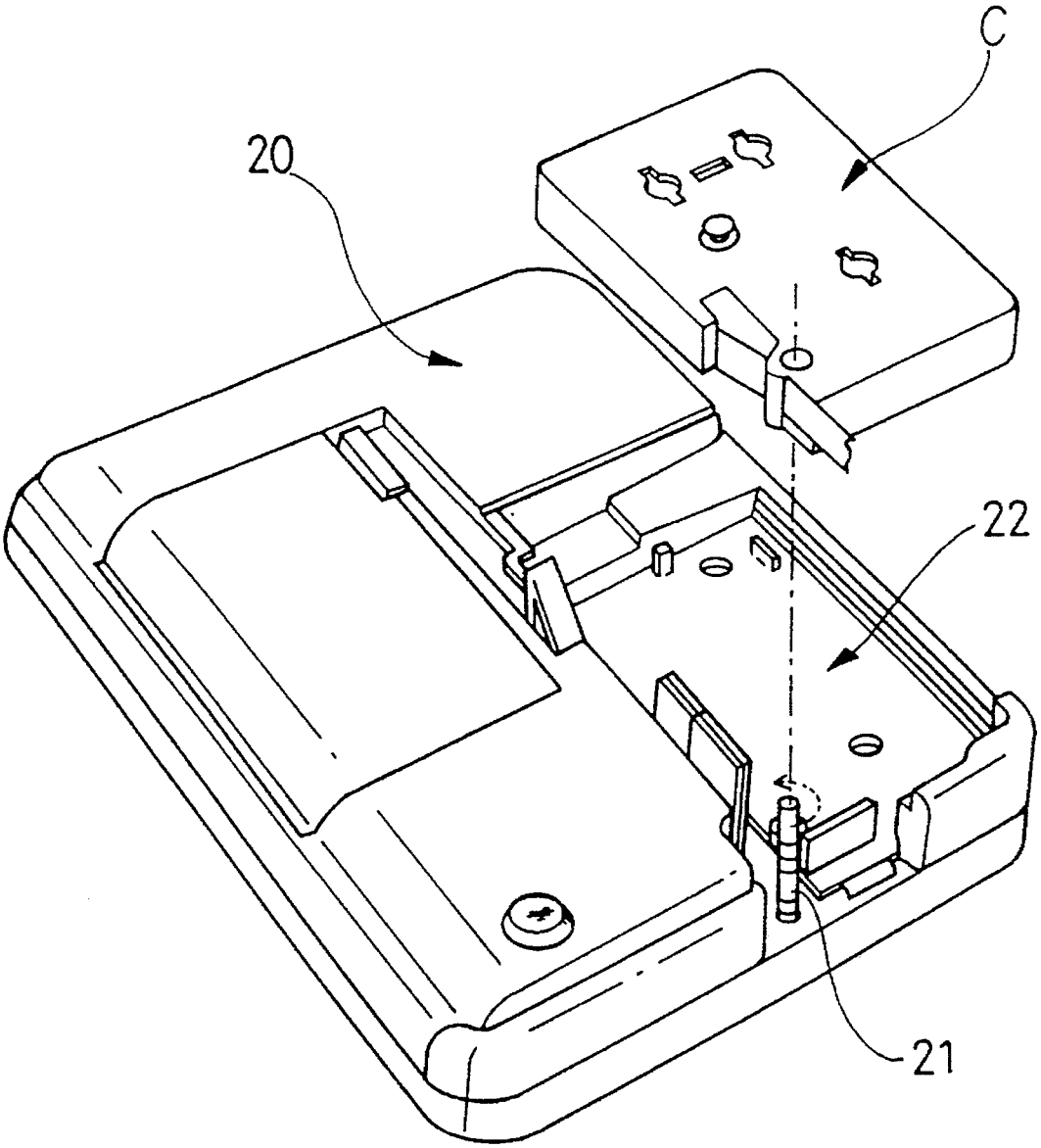
FIG. 3 is a perspective view of a tape printer in which the tape cartridge is utilized.

Hereinafter, by reference to FIGS. 2 and 3, there will be described the manner of production of printed tape by using the printing tape T. Here, FIG. 2 is a plan view of a lower half housing of a tape cartridge, with an upper half of housing (not shown) being removed and FIG. 3 is a perspective view of a tape printer which includes a thermal head for thermally recording images on the printing tape T.

First, the printing tape T as described above is cut into 12 mm width web before the printing tape T is arranged in the cartridge C. Subsequently, the thus obtained printing tape T is wound around a tape spool 10 having a 12 mm outer diameter and a 12 mm height, such that the removable sheet 6 is located outside. The tape spool 10 is accommodated in the lower housing 11, as shown in FIG. 2, such that the tape spool 10 is rotatably supported by the lower housing and the upper housing (not shown).

In the lower housing 11, the printing tape T is fed from the tape spool 10 to a printing section 13 via a tape guide member 12. The feeding of the printing tape T is effected by a tape feed roller 14 which is driven, when the cartridge C is set in the printer 20, by a tape feed shaft 21 of the printer 20. With the cartridge C being set in the printer 20, the thermal head 15 of the printer 20 is positioned in the printing section 13. The thermal head 15 is fixedly disposed in a cartridge receiving area 22 of the printer 20, and has a plurality of heat generating elements vertically arranged in an array. In addition, the printer 20 has a roller support member 16 which is disposed opposite to the thermal head 15 such that the roller support member 16 is pivotable about an axis member 19 fixed to the printer 20.

A platen roller 17 and a presser roller 18 are rotatably supported by the roller support member 16. When the thermal head 15 records characters and/or other images on the printing tape T, the roller support member 16 is rotated conterclockwise about the axis member 19. Thus, the platen roller 17 is pressed against the thermal head 15, so that the thermal head 15 can record with stability images in the thermal chromogenic layer 3 of the printing tape T. Concurrently, the presser roller 18 is pressed against the tape feed roller 14 of the cartridge C, so that the two rollers 18, 14 cooperate with each other to feed the thus printed length of the printing tape T out of the cartridge C.

The tape cartridge C is inserted in the tape receiving area 22 provided in a rear section (in the right-hand portion as seen in FIG. 3) of the printer 20. Electric current is selectively applied to the individual heat generating elements of the thermal head 15, so that the thermal head 15 heats selected areas of the thermal chromogenic layer 3 of the printing tape T. The chromogenic material reacts with the color developer and thereby develops color, in the heated areas of the chromogenic layer 3. Thus, the desired images such as characters are imprinted in the chromogenic layer 3 of the printing tape T.

Thereafter, the printing tape T on which the images are imprinted is fed out of the tape cartridge C through cooperation of the tape feed roller 14 and the presser roller 18. And the fed out printing tape T is cut out by a cutter, and the thus cut out printing tape T becomes the printed tape.

The printed tape, which is produced by imprinting the images in the chromogenie layer 3 of the printing tape T through the tape printer 20, can be adhered on an object through adherent force of the adhesive layer 5 after the removable sheet 6 is peeled.

As mentioned above, in the printing tape T of the embodiment embodying the present invention, the protection layer 2 is formed on the thermal ehromogenic layer 3 which is formed on one surface of the support sheet 4 and the colored transparent layer 1 which is formed of the resin curable at ordinary temperature including the dispersed pigment or the dissolved dye therein, is formed on the protection layer 2. Therefore, the images such as characters imprinted in the chromogenic layer 3 while printing thereof are clearly recognized through the background color defined by the colored transparent layer 1 in which the color of the pigment or dye directly reproduced.

Thus, since the background color of the characters or images in printed tape is defined by the color of the colored transparent layer 1 which is formed on the uppermost surface of the printing tape T, it is not necessary that the thermal chromogenie layer 3 is transparent, thereby the materials used for the dye, the color developer, the reaction promoter and the binder for forming the thermal chromogenie layer 3 can be freely selected. As a result, the materials utilizable for forming the chromogenic layer 3 are increased. Further, similar to the thermal chromogenic layer 3, since it is not necessary that the support sheet 4 is transparent, the materials used for the support sheet 4 can be freely selected, thereby the materials utilizable for the support sheet 4 are increased.

And the adhesive layer 5 is exposed on the surface of the support sheet 4 opposite to the surface where the thermal chromogenic layer 3 is formed by peeling the removable sheet 6 from the printed tape, therefore the printed tape can be adhered on a surface of a desired object through adherent force of the adhesive layer 5.

Further, the colored transparent layer 1 is mainly formed of the silicone resin curable at ordinary temperature and the thermal head 15 of the printer 20 is relatively moved while contacting with the colored transparent layer 1 when printing of the images is conducted. At that time, the thermal head 15 and the printing tape T are relatively and smoothly moved with each other through the colored transparent layer 1 formed of the silicone resin. In addition, life of the thermal head 15 can be lengthened without defacing thereof.

And in the printing tape T, the protection layer 2 is formed between the thermal chromogenic layer 3 and the colored transparent layer 1, therefore it can prevent the solvent included in the urethane resin solution for forming the colored transparent layer 1 from affecting or invading the thermal chromogenic layer 3, when coating the urethane resin solution on the thermal chromogenic layer 3 to form the colored transparent layer 1.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A printing tape for a tape-recording printer including a thermal head which thermally records images on the printing tape, the printing tape having a background color and comprising:

a support sheet, a heat-sensitive layer formed on one surface of the support sheet, a protection layer formed on the heat-sensitive layer, and a colored transparent layer formed on the protection layer, which is mainly formed of silicone resin curable at room temperatures including colorant, wherein the background color of the printing tape is based on the colorant.

2. The printing tape according to claim 1, wherein the resin in the colored transparent layer is composed of silicone resin which is curable at ordinary temperature.

3. The printing tape according to claim 1, wherein the resin in the colored transparent layer is composed of urethane resin which is curable at room temperature.

4. The printing tape according to claim 1, wherein the colorant is composed of pigment dispersed in the resin curable at room temperature.

5. The printing tape according to claim 4, wherein the pigment is organic pigment.

6. The printing tape according to claim 4, wherein the pigment is inorganic pigment.

7. The printing tape according to claim 1, wherein the colorant is composed of dye dissolved in the resin curable at room temperature.

8. The printing tape according to claim 7, wherein the dye is selected from the group consisting of xanthene dye, coumalin dye, merocyanine dye, thiazine dye, azine dye, methine dye, oxazine dye, phenylmethane dye, cyanin dye, azo dye, anthraquinone dye, pyrazoline dye, stilbene dye and quinoline dye.

9. The printing tape according to claim 1, wherein the colored transparent layer is formed on the protection layer by coating solution in which the resin curable at room temperature and solvent are mixed with each other, and wherein the protection layer protects the heat-sensitive layer from the solvent in the solution.

10. The printing tape according to claim 9, wherein the protection layer is formed of one or more water-soluble resins which have film-forming ability.

11. The printing tape according to claim 10, wherein the water-soluble resin is selected from the group consisting of polyvinyl alcohol, methyl cellulose, ethyl cellulose, carboxymethyl cellulose, hydroxyethyl cellulose, polyacrylamide, starch, gelatin, polyvinyl pyrrolidone and methoxy cellulose.

12. The printing tape according to claim 1, wherein the colored transparent layer is formed on the protection layer by coating solution in which the resin curable at room temperature and water are mixed with each other, and wherein the protection layer protects the heat-sensitive layer from the water in the solution.

13. The printing tape according to claim 12, wherein the protection layer includes anti-water agent.

14. The printing tape according to claim 13, wherein the anti-water agent is selected from the group consisting of formalin, glyoxal, chrome alum, melamine, melamine formalin, polyamide resin and polyamide epichlorhydrin resin.

15. The printing tape according to claim 1, further comprising an adhesive layer formed on the other surface of the support sheet opposite to the one surface where the heat-sensitive layer is formed and a removable sheet adhered on the adhesive layer.

16. The printing tape according to claim 15, wherein the printing tape is used so as to adhere on an object through the adhesive layer by removing the removable sheet therefrom after the images are thermally recorded by the thermal head in the tape-recording printer.

17. A printing-tape cartridge accommodating a printing tape, for use with a tape-recording printer including a thermal head which thermally records images on the printing tape, the printing-tape cartridge comprising:

a housing;

a tape spool disposed inside the housing so that the tape spool is rotatable, the printing tape being wound around the tape spool;

wherein the printing tape, having a background color, comprises a support sheet, a heat-sensitive layer formed on one surface of the support sheet, a protection layer formed on the heat-sensitive layer and a colored transparent layer formed on the protection layer, the colored transparent layer being mainly formed of silicone resin curable at room temperatures including colorant, the background color of the printing tape is based on the colorant.

18. The printing-tape cartridge according to claim 17, further comprising an adhesive layer formed on the other surface of the support sheet opposite to the one surface where the heat-sensitive layer is formed and a removable sheet adhered on the adhesive layer.

* * * * *